US009341032B2

(12) United States Patent
Jewett

(10) Patent No.: US 9,341,032 B2
(45) Date of Patent: May 17, 2016

(54) CENTRALIZER WITH COLLABORATIVE SPRING FORCE

(71) Applicant: PORTABLE COMPOSITE STRUCTURES, INC., Irvine, CA (US)

(72) Inventor: Scott Jewett, Irvine, CA (US)

(73) Assignee: PORTABLE COMPOSITE STRUCTURES, INC., Irvine, CA (US)

( * ) Notice: Subject to any disclaimer, the term of this patent is extended or adjusted under 35 U.S.C. 154(b) by 0 days.

(21) Appl. No.: 14/743,053

(22) Filed: Jun. 18, 2015

(65) Prior Publication Data

US 2015/0368990 A1 Dec. 24, 2015

Related U.S. Application Data

(60) Provisional application No. 62/013,690, filed on Jun. 18, 2014.

(51) Int. Cl.
*E21B 17/10* (2006.01)

(52) U.S. Cl.
CPC ..... *E21B 17/1078* (2013.01); *E21B 17/1014* (2013.01); *E21B 17/1021* (2013.01); *E21B 17/1028* (2013.01)

(58) Field of Classification Search
CPC ..... E21B 17/1078; E21B 17/1014; E21B 17/1021; E21B 17/1028; E21B 37/02599; E21B 37/02
See application file for complete search history.

(56) References Cited

U.S. PATENT DOCUMENTS

| | | | |
|---|---|---|---|
| 3,070,167 | A | 12/1962 | Loy, III et al. |
| 3,172,475 | A | 3/1965 | Moore |
| 3,237,696 | A | 3/1966 | Hall, Sr. |
| 3,343,608 | A | 9/1967 | Solum |
| 3,555,689 | A | 1/1971 | Cubberly, Jr. |
| 4,595,055 | A | 6/1986 | Vannier |
| 4,790,381 | A | 12/1988 | Armell |
| 5,148,867 | A | 9/1992 | Coyle |
| 5,358,039 | A | 10/1994 | Fordham |
| 6,915,856 | B2 | 7/2005 | Gentry et al. |
| 7,191,829 | B2 | 3/2007 | Bloom et al. |
| 7,431,096 | B2 | 10/2008 | Fay |
| 8,061,447 | B2 | 11/2011 | Krueger |
| 2007/0181298 | A1 * | 8/2007 | Sheiretov ..... E21B 4/18 166/212 |

OTHER PUBLICATIONS

Copenheaver, Blaine; Written Opinion of the International Searching Authority, Aug. 26, 2015; PCT.

MSC Software, "Virtual Prototyping of Centralizer Mechanisms Used in the Oil and Gas Industry", youtube.com, https://www.youtube.com/watch?v=94FTo4ukBuw (See attached screen shots of video).

* cited by examiner

*Primary Examiner* — Cathleen Hutchins
(74) *Attorney, Agent, or Firm* — Russo & Duckworth, LLP; David G. Duckworth

(57) ABSTRACT

A centralizer for centralizing a pipe is provided which collaborates the spring force of its bow springs. The centralizer includes a pair of end collars, and at least one center collar. Each of the collars has a center hole for coaxially receiving a pipe. In addition, the centralizer includes a plurality of longitudinally extending and arcuate bow springs having ends which affix to the end collars. The centralizer includes linkage arms which connect the center collar to the bow springs. The linkage arms may provide additional outward spring force against the bow springs. Preferably, the centralizer includes a mechanism for forcing the bow springs radially inward from their at rest position.

7 Claims, 12 Drawing Sheets

CENTRALIZER WITH COLLABORATIVE SPRING FORCE

RELATED APPLICATIONS

The present application is a continuation-in-part of U.S. Provisional Patent Application Ser. No. 62/013,690 filed on Jun. 18, 2014.

BACKGROUND OF THE INVENTION

The present invention relates to the construction of subterranean wells. More particularly, the present invention relates to methods and constructions for centering a casing within a well, particularly an oil or gas well.

A well is a subterranean boring from the Earth's surface that is designed to find and acquire liquids or gases. Wells for acquiring oil are termed "oil wells". A well that is designed to produce mainly gas is called a "gas well". Typically, wells are created by drilling a bore, typically 5 inches to 40 inches (12 cm to 1 meter) in diameter, into the earth with a drilling rig that rotates a drill string with an attached bit. After the hole is drilled, sections of steel pipe, commonly referred to as "casings" and which are slightly smaller in diameter than the borehole, are dropped "downhole" into the bore for obtaining the sought after liquid or gas.

The difference in diameter of the wellbore and the casing creates an annular space. When completing oil and gas wells, it is often important to seal the annular space with cement. This cement is pumped down into the annular space, often flushing out drilling mud. Once the annular space is filled with cement, the cement is allowed to harden to seal the well. To properly seal the well, the casing should be positioned so that it is in the middle or center of the annular space. The casing and cement provide structural integrity to the newly drilled wellbore and provide isolation of potentially dangerous high pressure zones. Thus, centralizing a casing inside the annular space is paramount and critical to achieve a reliable seal, and thus good zonal isolation. With the advent of deeper wells and horizontal drilling, centralizing the casing has become more important and more difficult to accomplish.

A traditional method to centralize a casing is to attach centralizers to the casing prior to its insertion into the annular space. Most traditional centralizers have tabs, wings or bows that exert force against the inside of the wellbore to keep the casing somewhat centralized. The centralizers are commonly secured at intervals along a casing string to radially offset the casing string from the wall of a borehole in which the casing string is positioned. Centralizers ideally center the casing string within the borehole to provide a generally continuous annulus between the casing string and the interior wall of the borehole. This positioning of the casing string within a borehole promotes uniform and continuous distribution of cement slurry around the casing string. Uniform cement slurry distribution results in a cement liner that reinforces the casing string, isolates the casing from corrosive formation fluids, prevents unwanted fluid flow between penetrated geologic formations, and provides axial strength.

A bow spring centralizer is the most common type of centralizer. It employs flexible bow springs to provide offset between the casing and wellbore sidewall. Bow spring centralizers typically include a pair of axially-spaced and generally aligned tubular collars that are coupled by multiple bow springs. The bow springs expand outwardly from the collars to engage the borehole sidewall to center a pipe received axially through the collars. Configured in this manner, the bow springs provide stand-off from the borehole, and flex inwardly as they encounter borehole obstructions, such as tight spots or protrusions into the borehole, as the casing string is installed into the borehole. Elasticity allows the bow springs to spring back to substantially their original shape after passing an obstruction to maintain the desired stand-off between the casing string and the borehole. Examples of such bow springs are disclosed in U.S. Pat. No. 4,545,436 and Great Britain Patent No. 2242457 which both disclose casing centralizers having a plurality of bow springs which are connected to first and second collars. The collars surround the well casing, and one or both of the collars slide longitudinally upon the pipe when the bow spring is deformed upon engaging the wellbore sidewall.

The use of bow spring centralizers presents a number of disadvantages and their installation is problematic. To achieve the desired centralization, bow centralizers are designed so that, prior to installation the bow springs extend beyond the inside diameter ("ID") of the wellbore. The larger diameter of said bow springs requires them to be refracted from the force of pushing it down inside the casing or wellbore. This causes kinetic friction when slid down the hole (requiring running force) and also static friction when engaging restrictions or obstructions (requiring starting force). This friction is a primary reason that their use is discouraged. Further, the radial configuration of the bow springs causes the spring force of one bow spring to be counteracted by the bow springs on the opposite side of the casing. This results in a restoring force that diminishes as the casing approaches center, making better centralization require greater and greater spring forces. Furthermore, increased spring forces also increases running and starting resistance. Therefore, a balance is sought between the needed forces to centralize the casing and the increased resistance that these spring forces create.

An additional disadvantage of bow spring centralizers is that the bow springs obstruct the pumping of cement downhole. After being positioned downhole, the bow springs project radially outward from the casing like spokes to engage the wellbore's cylindrical wall. These bow springs can block the proper downward flow of the cement slurry or can create voids in the annular cement structure.

Various attempts have been made to develop centralizers that overcome some of these problems. U.S. Pat. No. 6,871,706 discloses a centralizer that requires the bending of a retaining portion of the collar material into a plurality of aligned openings, each to receive one end of each bow spring. This requires that the coupling operation be performed in a manufacturing facility using a press. The collars of the centralizer are cut with a large recess adjacent to each set of aligned openings to accommodate passage of a bow spring that is secured to the interior wall of the collar. Unfortunately, the recess substantially decreases the mechanical integrity of the collar due to the removal of a large portion of the collar wall to accommodate the bow springs.

U.S. Patent Publication 20120279725 and U.S. Pat. No. 7,857,063 describe centralizers that have a minimal radial expansion prior and during the casing's transportation downhole. Only after the casing is in place are the centralizer tabs expanded radially outward. This reduces the amount of friction that the casing string encounters as it is dropped downhole. Furthermore, the tabs extend laterally relative to the pipe's central axis in a manner that minimizes the obstruction to the flow of cement as it is poured downhole. Unfortunately, these centralizers are not suitable for traditional metal well casings that provide minimal radial expansion. Instead, the centralizers are useful only for centralizing tubular members capable of substantial expansion so as to force the centralizer tabs to engage the borehole wall.

Thus, there is a significant need for an improved casing centralizer that provides reduced friction as the centralizer is transported downhole.

There is a also a need for an improved casing centralizer that provides increased centralizing force for maintaining a casing in the center of a wellbore.

Still there is an additional need for an improved casing centralizer that provides minimal impedance to the flow of cement as cement is pumped downhole in the annular space between the casing string and the wellbore wall.

In addition, there is a need for an improved centralizer that provides reduced manufacturing and installation costs, and provides an improved ease of running the casing string downhole into the wellbore.

SUMMARY OF THE INVENTION

The present invention addresses the aforementioned disadvantages by providing an improved centralizer for centralizing a pipe downhole in a well. The term "pipe" is intended to be interpreted in the traditional sense as a cylindrical structure having an exterior wall and a central conduit. Furthermore, the term "pipe" is intended to include traditional well casings, casing strings, and casing couplers which connect casings to form a casing string. Moreover, the centralizer of the present invention may be integrated into the pipe so as to include the pipe's cylindrical exterior sidewall and central conduit which defines the pipe's longitudinal axis. Alternatively, the centralizer may include a structure for affixing the centralizer to a pipe, such as for affixing to a pipe immediately prior to the pipe being transported downhole into a well.

The centralizer of the present invention includes a pair of end collars. Each end collar is tubular and has a center hole for receiving a pipe. The end collars' tubular structure forms a longitudinal axis, and the end collars are positioned to receive a pipe coaxial to the longitudinal axis. The end collars are spaced longitudinally from one another and at least one end collar is capable of sliding telescopically and axially relative to the pipe. In alternative embodiments, both end collars are sized to freely rotate and slide longitudinally upon the pipe. Preferably, the end collars' inside diameter is only slightly larger than the outside diameter of the casing or pipe to be centralized, and it is permissible for one of the end collars to have an inside diameter substantially the same as the outside diameter of the pipe so as to form a press-fit engagement. Mechanical fasteners such as circular bands may be affixed to the exterior of the well pipe so as to prevent the centralizer from sliding from its desired location.

The centralizer further includes a plurality of longitudinally extending bow springs. The bow springs are elastic members which store mechanical energy so as to exert a resisting force when its shape is changed. Each bow spring has first and second ends wherein a bow spring's first end is affixed to a first end collar, and a bow spring's second end is affixed to a second end collar. The bow springs are arcuate so as to bow outwardly at their middle so as to form a radially extending arch capable of pushing against the inner wall of a wellbore. The bow springs are preferably positioned circumferentially and equally about the end collars so as to centralize a pipe within a wellbore and so as to form a substantially uniform annular space between the pipe and wellbore sidewall. Preferably, the bow springs are made of spring steel. As would be understood by those skilled in the art, radial compression of the bow springs causes the end collars to move longitudinally away from one another. When the source of the compression, such as the wellbore sidewall, is removed, the mechanical energy stored within the bow springs will cause the bow springs to expand radially, and cause the end collars to contract longitudinally.

The centralizer of the present invention also includes one or more center collars. Like the end collars, the center collar has a tubular structure having a center hole sized to slidably receive the pipe. The center collar is positioned coaxial to the pipe and intermediate to the first and second end collars. Preferably the center collar is capable of rotating about the pipe and sliding longitudinally relative to the pipe. However, where the end collars are capable of sliding longitudinally relative to the pipe, it is permissible for the centralizer's center collar to be affixed to the pipe.

The centralizer of the present invention includes a linkage assembly that forces the bow springs to move radially and in unison. The linkage assembly includes a plurality of linkage arms wherein each arm has a first end and a second end. Each linkage arm's first end attaches to a center collar and each linkage arm's second end attaches to a bow spring member so that the linkage arms extend radially like spokes from the exterior of the pipe to a bow spring. Each linkage arm extends radially and at least partially longitudinally so that when a bow spring is compressed, the linkage arms can be compressed as well while forcing the center collar to move longitudinally. Preferably, the linkage arms are formed of the same material, such as spring steel, that forms the collars and bow springs.

In a preferred embodiment, the linkage arms are constructed to bias outwardly in the manner of springs by storing mechanical energy to provide additional force causing the bow springs to be forced radially outward. In alternative embodiments, the leverage arms are affixed to the center collar and respective bow springs by hinges or the like so that the leverage arms do not store mechanical energy and do not function as springs. In either embodiment, spring or hinged, the compression of one or more bow springs radially inward causes the linkage assembly (comprised of the linkage arms) to force the center collars in the longitudinal direction. As would be understood by those skilled in the art, inward compression of a single bow spring causes the corresponding linkage arm to force the center collar in the longitudinal direction, which in turn causes the remaining linkage arms to force the remaining bow springs radially inward.

The centralizer may be constructed so that the bow springs curve outward so that their at-rest curvature would extend beyond the inside diameter of the intended wellbore so that the bow springs engage and are slightly compressed as the well pipe and centralizer are deposited downhole. However, to reduce running force (frictional resistance between the centralizer and wellbore) the centralizer may be constructed to force the bow springs radially inward to reduce the outer diameter of the bow springs, and to store mechanical energy in the bow springs. Various constructions may be employed. For example, the end collars may be forced longitudinally outward and locked in an extended position utilizing bolts or pins, or other projections, which extend outwardly from the well pipe. Longitudinal extension of the respective end collars causes the bow springs to compress radially inward, which in turn causes the center collar to move longitudinally from its at-rest position.

In alternative embodiments, the pipe may include locking rings which affix to the pipe for engaging both end collars so to maintain the end collars longitudinally apart. Still additional constructions can be developed by those skilled in the art so as to maintain the end collars in an extended position, with the bow springs compressed radially inward, while still enabling the end collars to extend still longitudinally further.

In additional embodiments, the centralizer includes spacers which affix to the exterior of the pipe for forcing the linkage arms and bow springs radially inward. In a first embodiment, a spacer is positioned between an end collar and center collar so as to move the center collar longitudinally from its at-rest position. The movement of the center collar causes the linkage arms to be forced radially inward, which in turn causes the bow springs to be forced radially inward. In still an alternative embodiment, the centralizer includes two sets of center collars, and two sets of linkage arms. As the bow springs are compressed, a first center collar moves longitudinally in a first direction, while the second collar moves longitudinally in an opposite direction. To radially retract the bow springs, a preferred centralizer includes a spacer which is positioned between the two center collars so as to move the center collars longitudinally away from one another, which in turn causes the linkage arms and bow springs to move radially inward into a compressed condition.

Preferably, for each of these embodiments, the bow springs have been forced radially inward to a diameter less than the diameter of the wellbore so as to reduce the running force of the well casing as it is deposited downhole. Advantageously, each of the bow springs have been compressed to store mechanical energy so as to exert an increased restoring force when compressed further by the wellbore diameter decreasing to smaller than the diameter of the centralizer bow springs.

In still additional embodiments, the end collars and one or more center collars are hinged so as to include at least a first hinge so as to allow the centralizer to open in a clamshell member so as to clamp upon a well pipe. Preferably, each collar includes two diametrically opposed hinges which can open and close by a longitudinally extending set pin. Advantageously, set pins can be removed from one side of the centralizer so as to allow the centralizer to open in a clamshell manner so as to affix to a pipe. Thereafter, the pins can be reinserted so as to affix the centralizer to a well pipe.

Advantageously, the centralizer has a minimal cross section prior to being transported downhole so as to reduce the friction that the casing encounters as it is transported downhole.

In addition, the centralizer's center collars and linkage assemblies cause all of the bow springs to act in unison. The collaboration of the bow spring motion creates a compounded spring force that improves centralization. Moreover, the centralizer with bow springs operating in unison prevents a single bow spring from bowing inwardly, without the remaining bow springs moving inward, which would decentralize the well casing.

Also advantageously, the angle, length, and position of the linkage arms can be varied to provide the bow springs with the desired radial force.

These and other more specific objects and advantages of the invention will be apparent to those skilled in the art from the following description taken in conjunction with the drawings.

DETAILED DESCRIPTION OF THE INVENTION

Figure 1:
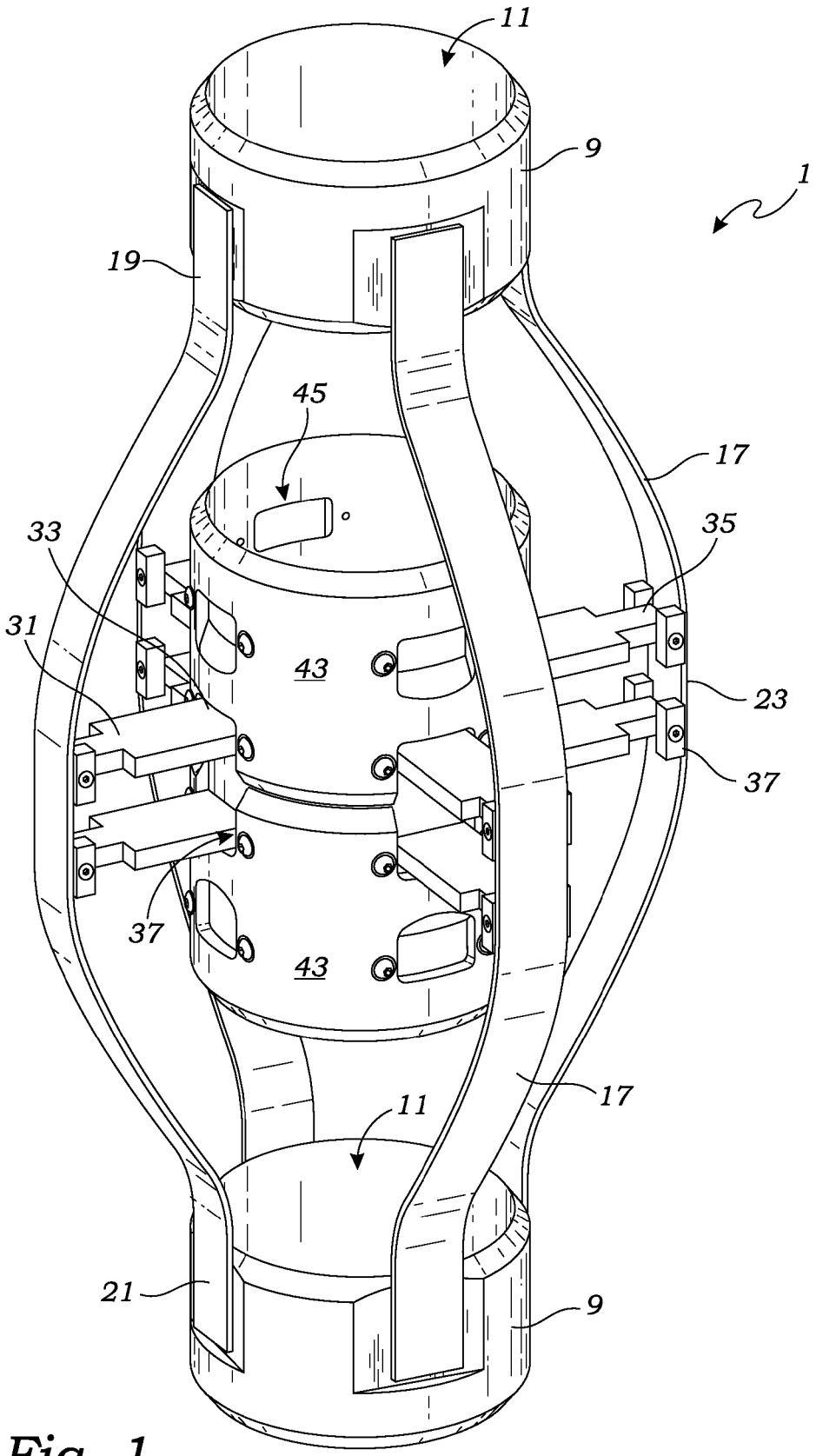
FIG. 1 is a perspective view of a centralizer including two center collars and hinged linkage arms.
Figure 2:
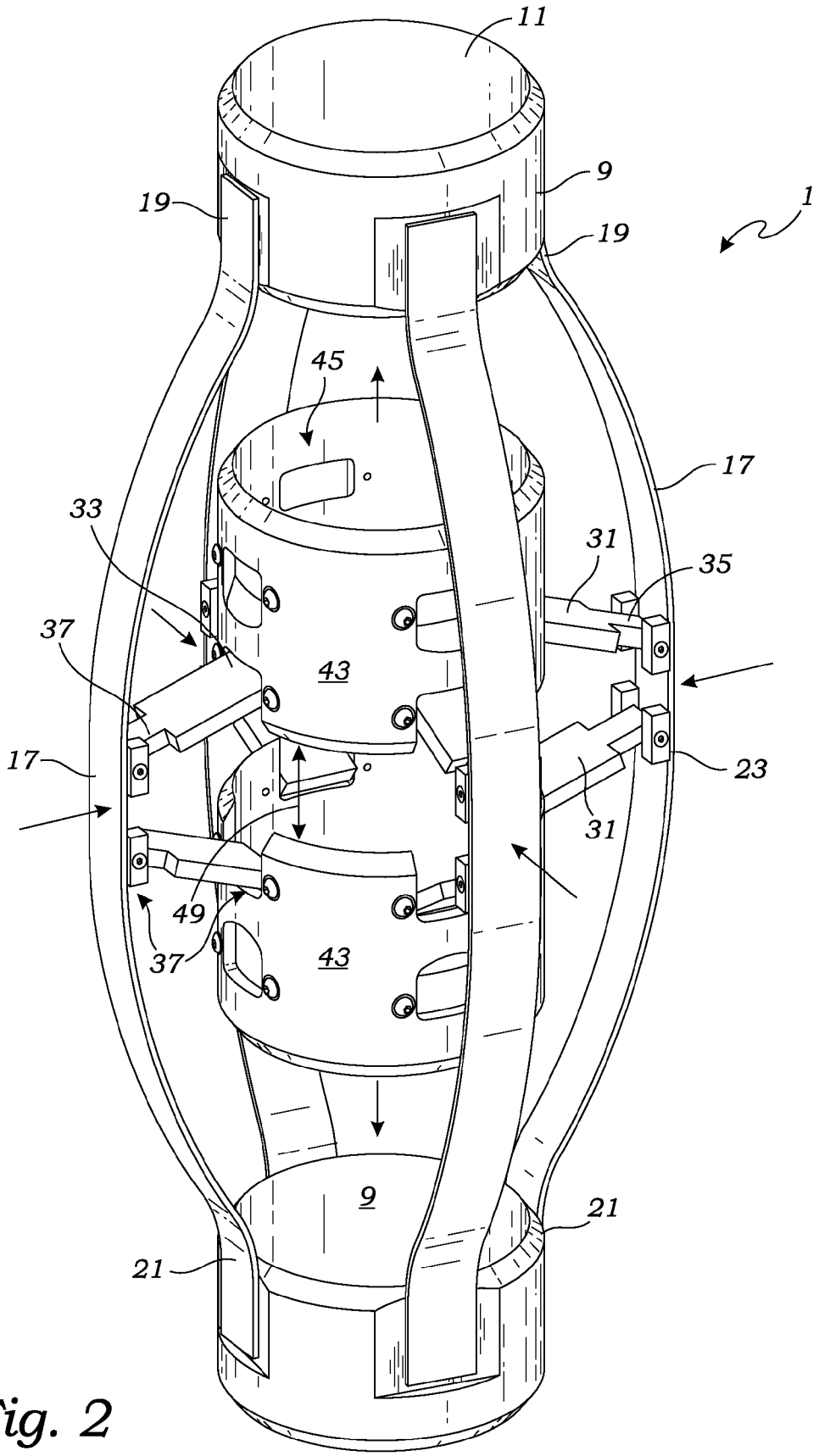
FIG. 2 is a perspective view illustrating the centralizer shown in FIG. 1 wherein the bow springs have been forced radially inward and the center collars have been moved longitudinally outward.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-12B, the present invention is a centralizer 1 for centralizing a pipe 3, also referred to as a casing or well casing, within a wellbore 5. The centralizer 1 includes two tubular end collars 9, each having a center hole 11 sized to receive a pipe 3. (See FIGS. 6-8 and 10-12). The end collars 9 are spaced longitudinally relative to one another and are positioned coaxial to the pipe 3. At least one end collar 9 is capable of sliding longitudinally relative to the pipe 3.

The end collars 9 are connected by a plurality of bow springs 17. Each bow spring 17 includes a first end 19 affixed to a first end collar 9 and a second end 21 affixed to a second end collar 9. The bow springs bow outwardly at their middle 23 so as to form a leaf spring type construction wherein radial inward compression of the bow spring's middle 23 causes the diameter of the bow springs, and in turn the centralizer, to reduce. This, in turn, causes the bow springs to extend longitudinally to force the end collars longitudinally away from each other. As illustrated in the figures, a preferred centralizer 1 has four bow springs 17 positioned equally circumferentially around the centralizer's central longitudinal axis so as to be positioned at 90° spacing to one another.

The centralizer 1 also includes at least one center collar 43. The centralizer's center collar 43 is constructed in a similar manner as the end collar 9 so as to have a center hole 45 for coaxially receiving the pipe 3. The center collar 43 is positioned and aligned so as to be intermediate the end collars 9 with the center collar's hole 45 coaxial to the end collars 9.

Figure 8A:
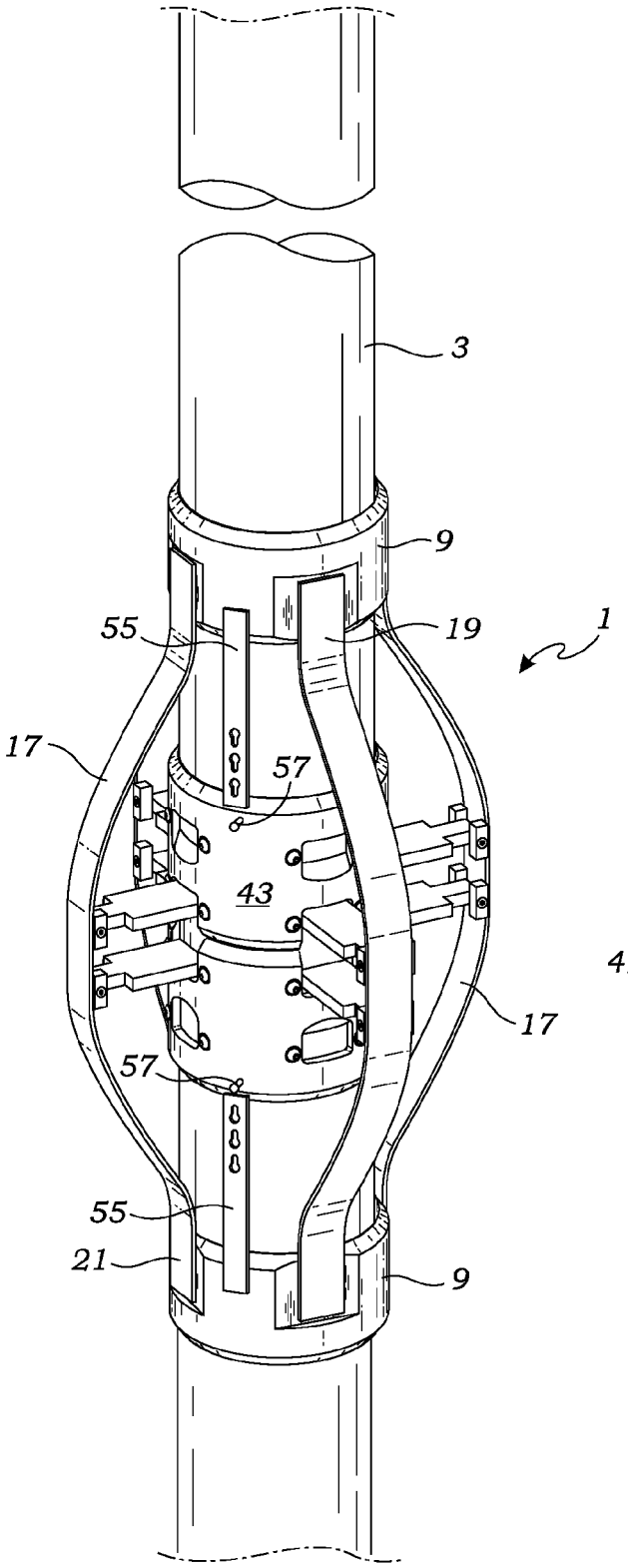
FIG. 8A is a perspective view illustrating a centralizer and well casing including flexible straps for pulling center collars apart.
Figure 8B:
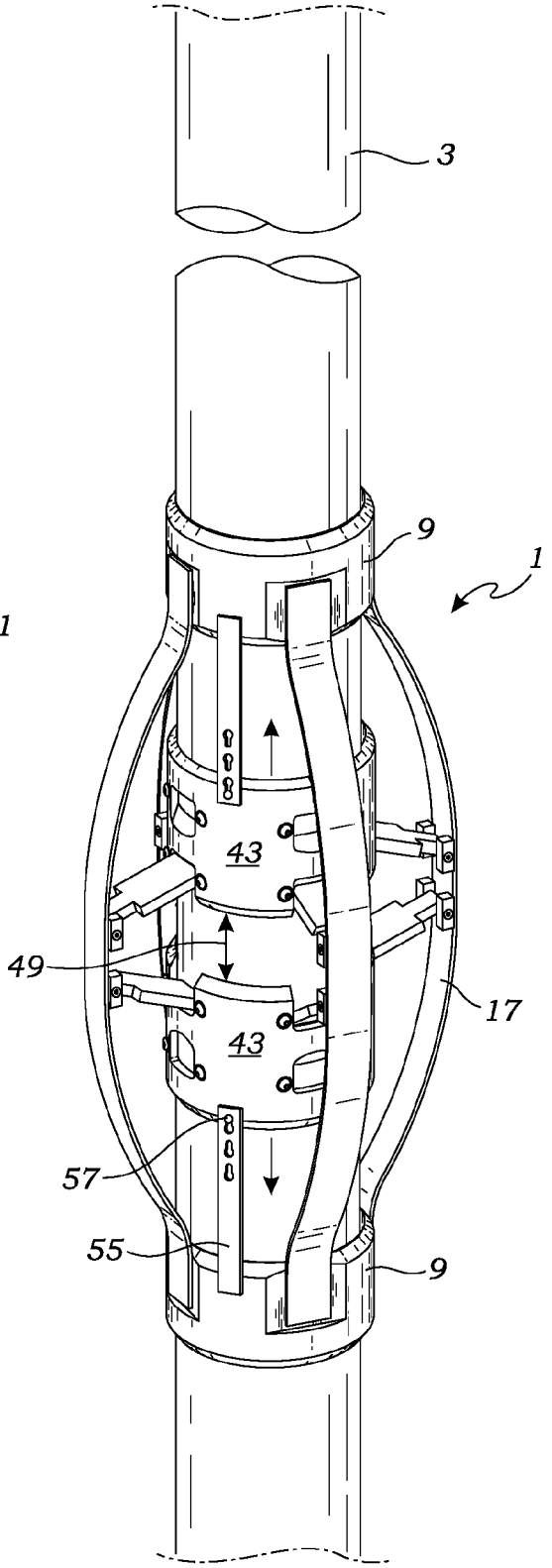
FIG. 8B is a perspective view illustrating a centralizer and well casing of FIG. 8A wherein the center collars have been forced longitudinally apart and locked in place utilizing flexible straps.
Figure 9A:
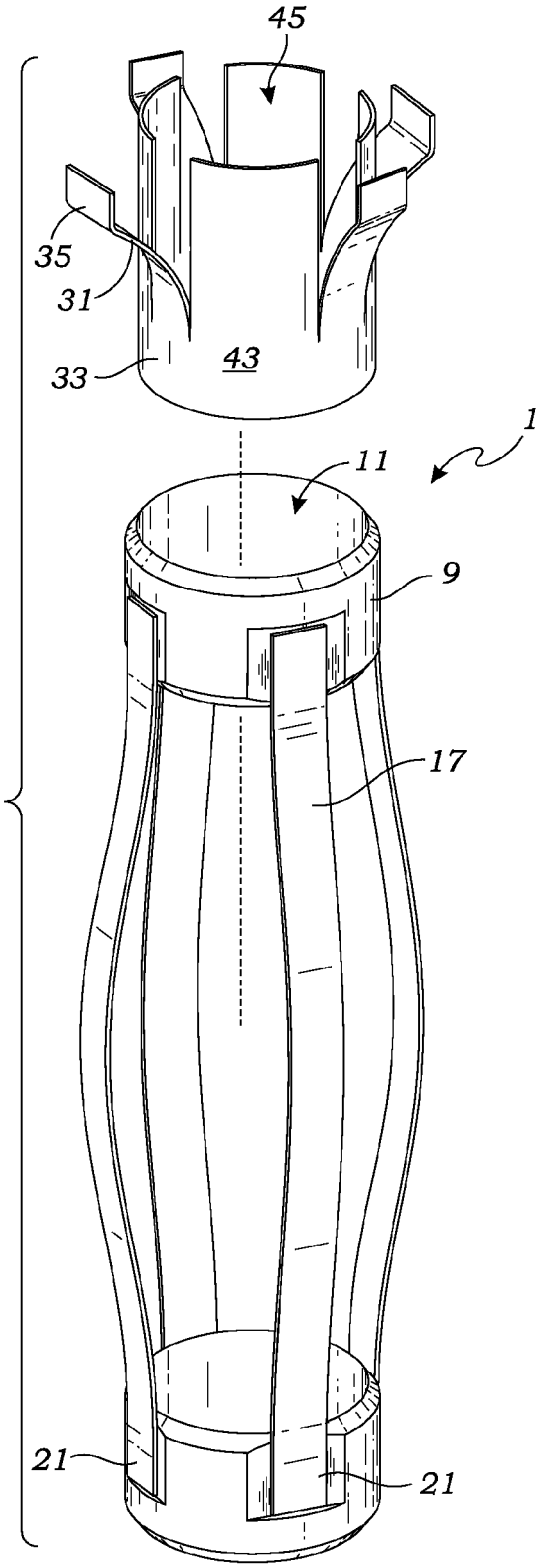
FIG. 9A is a perspective view of an additional embodiment of a centralizer wherein the linkage assemblies' linkage arms bias outwardly in the manner of leaf springs.
Figure 9B:
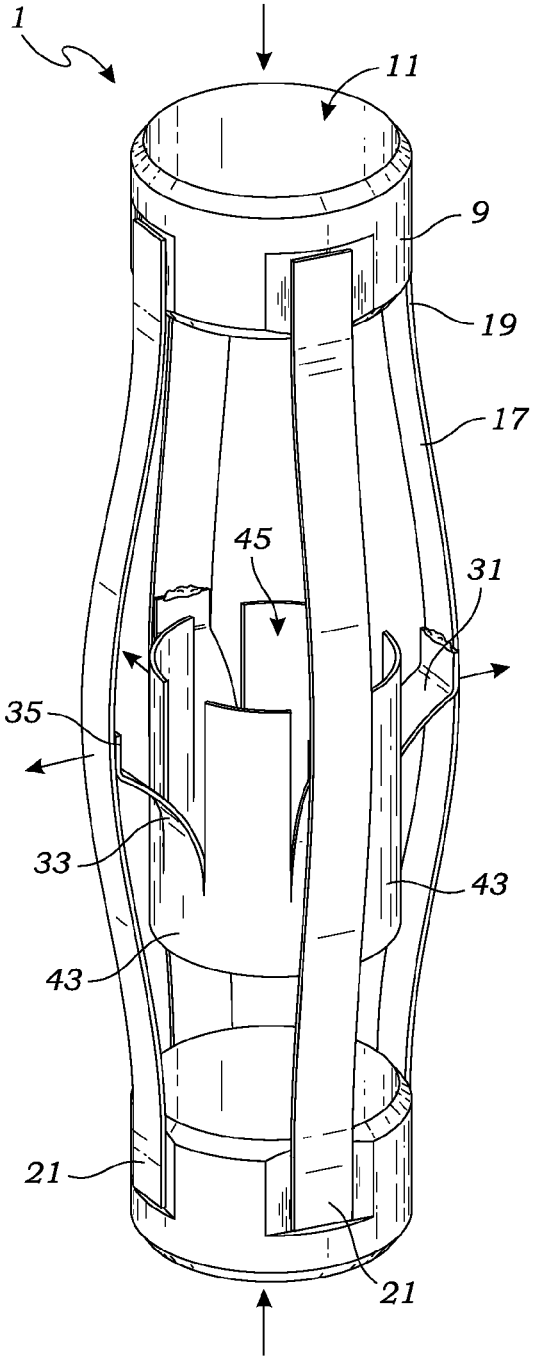
FIG. 9B is a perspective view illustrating the centralizer shown in FIG. 9A and illustrating the center collar's linkage arm providing additional force to move the bow springs radially outward.

Further, the centralizer includes a linkage assembly including linkage arms 31 which structurally connect the centralizer's center collar 43 to the bow springs 17. Each linkage arm 31 has a first end 33 which affixes to the center collar 43, and each linkage arm 31 includes a second end 35 which affixes to the bow spring 17, preferably at approximately the bow spring's middle 23. As illustrated in FIGS. 1-8B and 10A-12B, the linkage arms 31 may be connected to the bow springs 17 and center collar 43 utilizing hinges 37 which allow the linkage arms to freely pivot where they connect to the bow spring and center collar. Alternatively, as illustrated in FIGS. 9A and 9B, the centralizer may be constructed so that the linkage arms 31 do not freely pivot where they connect to the bow spring and center collar. Instead, for this embodiment, the linkage arms 31 function as springs storing mechanical energy providing additional force against the bow spring's middle 23.

Advantageously, the centralizer of the present invention can be constructed in a wide variety of manners. For example, as illustrated in FIGS. 3, 4, 9A and 9B, a preferred centralizer 1 includes only a single center collar 43 connected to the bow springs 17 by a single set of linkage arms 31. Alternatively, as illustrated in FIGS. 1, 2, 6-8B and 10A-12B, the centralizer 1 may include two center collars 43, and two sets of linkage arms 31 for connecting to the bow springs 17. Preferably, the first and second sets of linkage arms are constructed to extend laterally, and longitudinally in opposite directions (not parallel), so that the center collars 43 move longitudinally in opposite directions when the bow springs 17 are compressed radially inward. (See FIGS. 6, 7B, 8B and 10B).

Figure 7A:
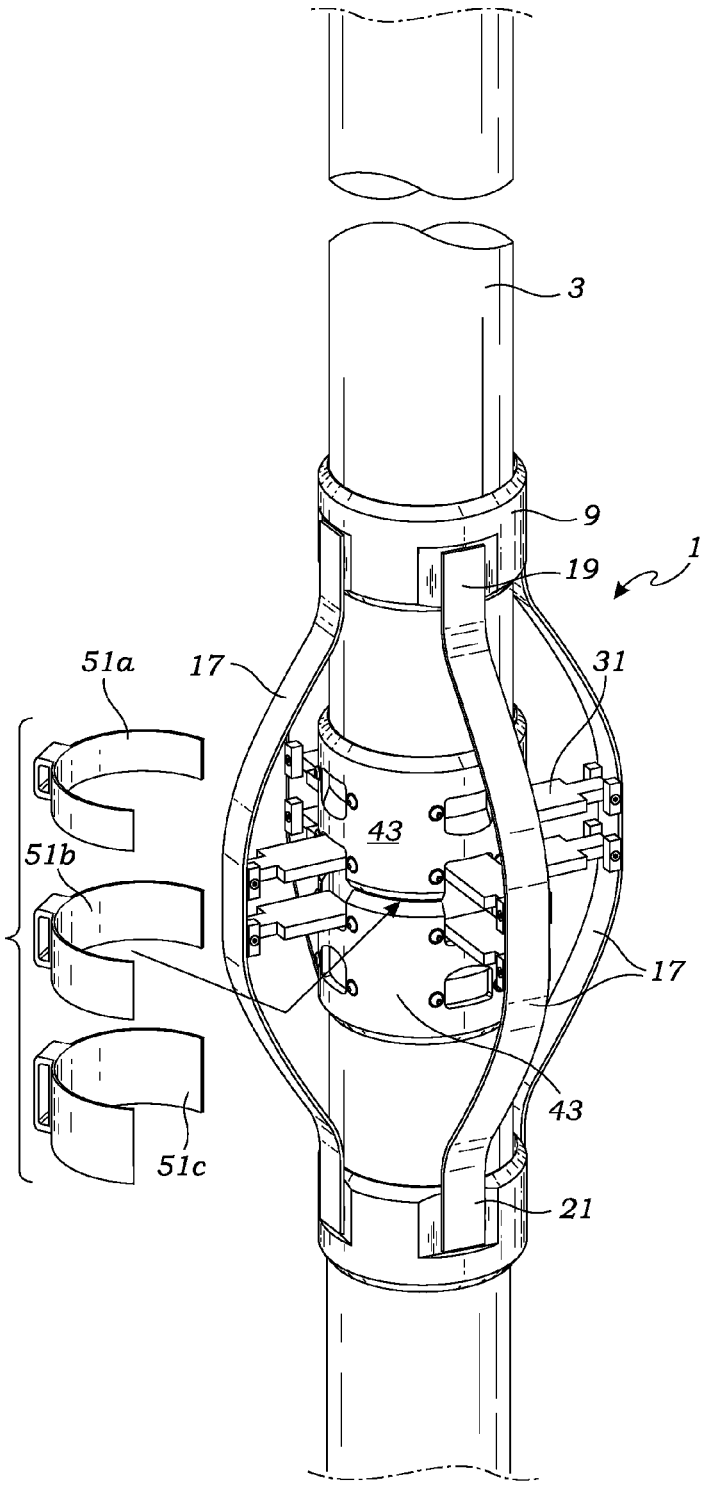
FIG. 7A is a perspective view illustrating a centralizer shown in FIG. 1 affixed to a well pipe prior to selection and insertion of a spacer.
Figure 7B:
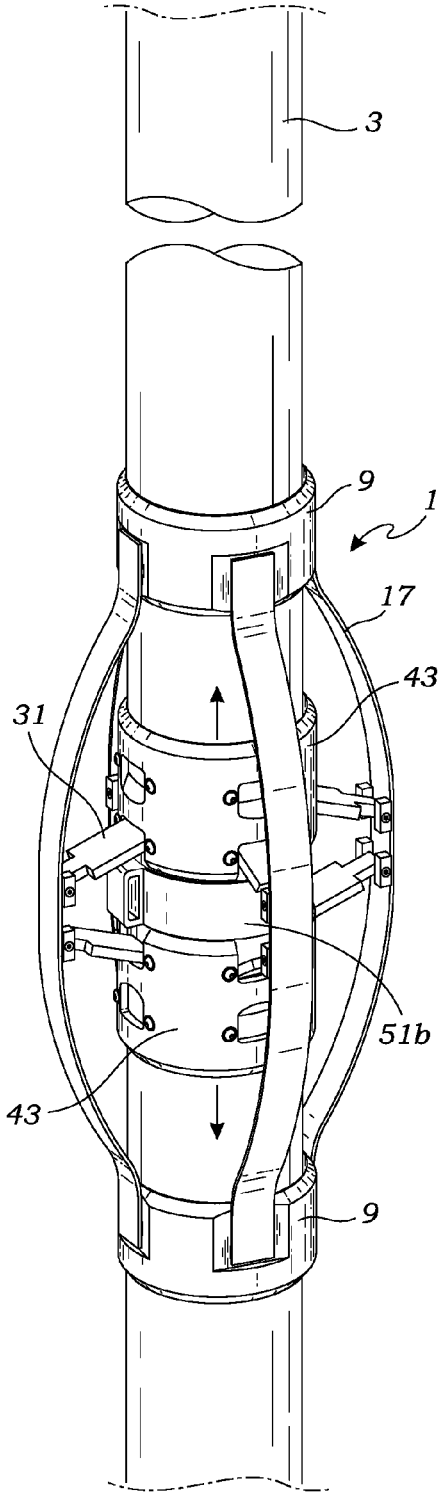
FIG. 7B is a perspective view illustrating the centralizer and pipe casing of FIG. 7A wherein the centralizer includes a spacer for forcing center collars longitudinally apart.
Figure 10A:
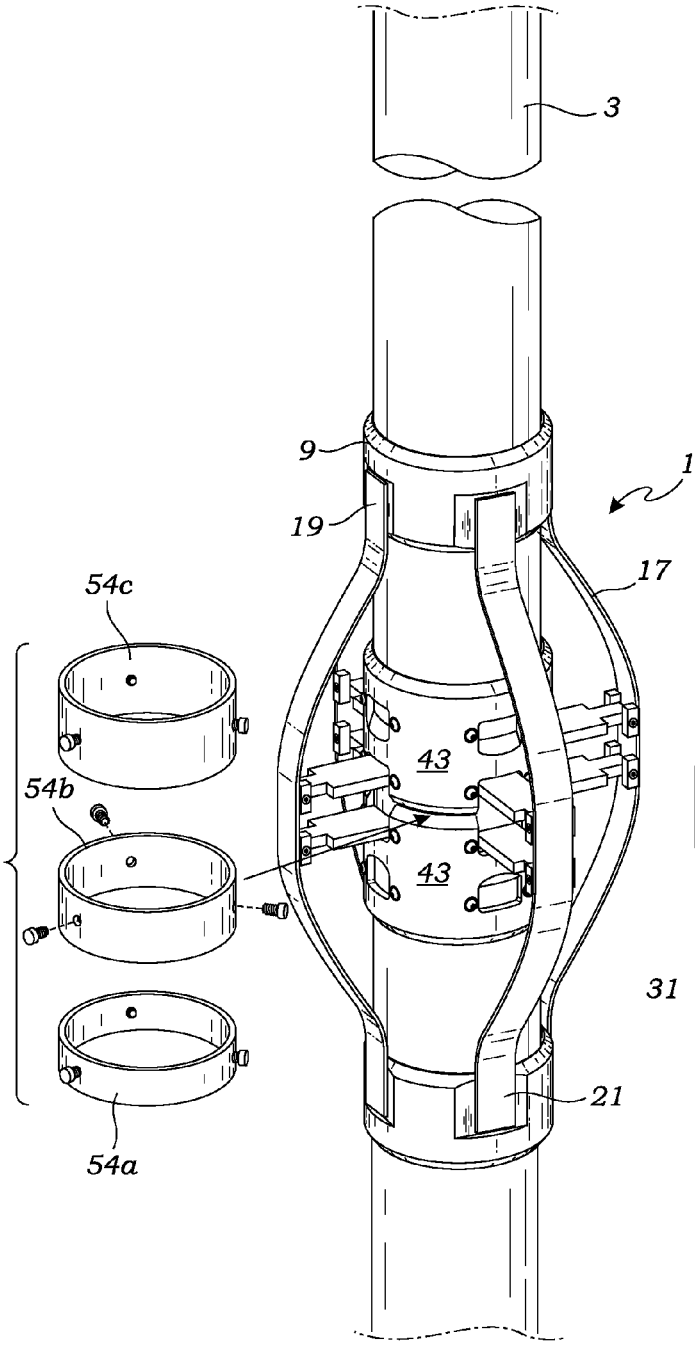
FIG. 10A is a perspective view illustrating a centralizer and well casing prior to selection of a spacer in the form of a ring.
Figure 10B:
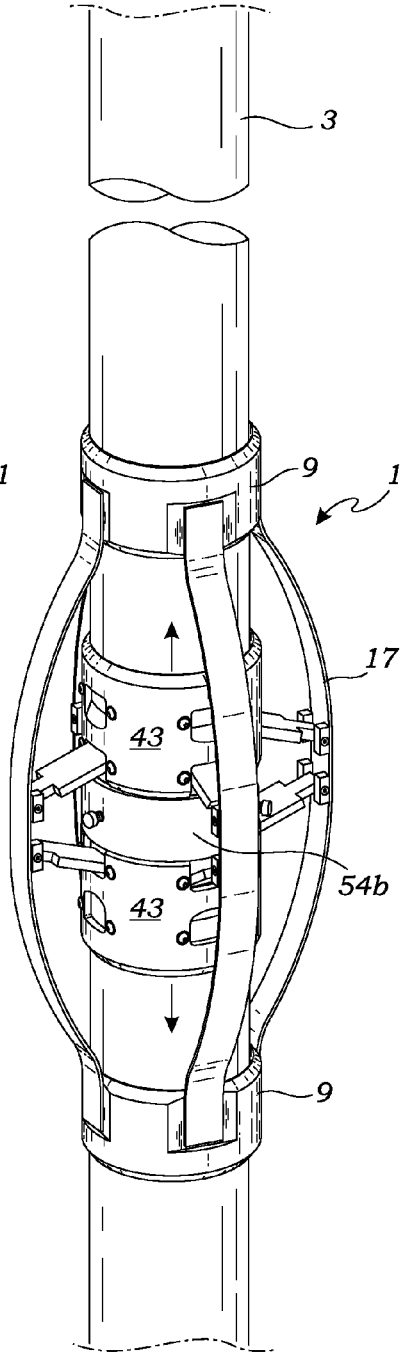
FIG. 10B is a perspective view illustrating the centralizer and well casing shown in FIG. 10A wherein a spacer of medium thickness has been selected.
Figure 12A:
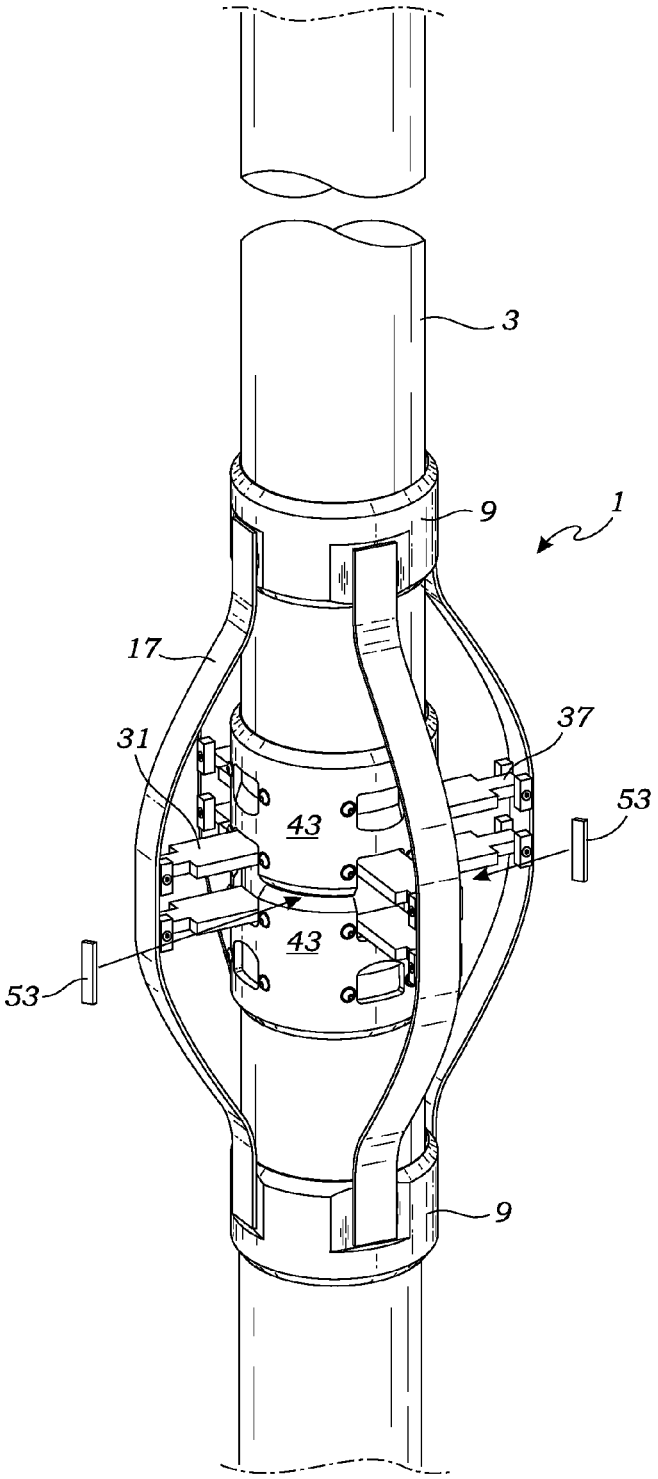
FIG. 12A is a perspective view illustrating a centralizer and well casing prior to insertion of longitudinal spacers between center collars.
Figure 12B:
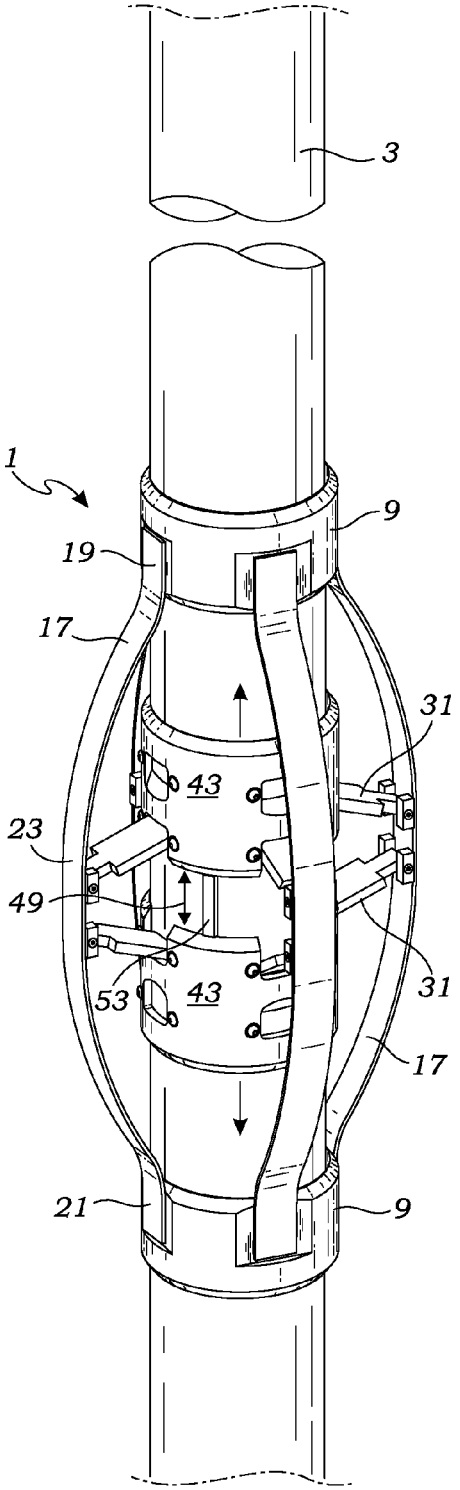
FIG. 12B is a perspective view illustrating the centralizer and well casing shown in FIG. 12A wherein longitudinal spacers have been positioned between center collars so as to force the center collars longitudinally apart.

Preferably, the centralizer 1 is constructed so that the bow springs 17 relaxed state causes the bow springs' outer diameter 23 to be larger than the wellbore, diameter within which it is placed. However, to reduce the running force of the well casing as it is deposited downhole, it is preferred that the centralizer include one of various mechanisms for displacing the bow springs' radially inward so as to have a diameter smaller than the average diameter of the wellbore. In a first embodiment illustrated in FIGS. 7A, 7B, 10A, 10B, 12A and 12B, the centralizer includes a spacer which forces the two center collars 43 axially apart, which in turn causes the linkage arms 31 to pull the bow springs 17 radially inward. For example, in a first embodiment illustrated in FIGS. 7A and 7B, the spacer may be an arcuate structure 51*abc* having different sizes. A person using the centralizer downhole may select a smaller spacer 51*a* wherein one wants to decrease the diameter of the bow springs slightly, but still maintain a substantially large diameter. Alternative spacers 51*b* or 51*c* could be selected to increase the longitudinal space 49 between the center collars 43 by selecting larger spacers such as 51*b* or 51*c*. For example, FIG. 7B illustrates the centralizer 1 of the present invention affixed to a pipe including an intermediate spacer 51*b* for longitudinally separating the center collars 43. FIGS. 10A and 10B illustrate an alternative spacer 54*abc* wherein the spacer is constructed in the form of a ring. A ring of desired thickness, such as a thin ring 54*a* or a thick ring 54*c*, is positioned between the center collars 43 prior to insertion of the pipe 3. For example, FIG. 10B illustrates a centralizer and pipe assembly incorporating a spacer 54*b* having a medium thickness which forces the bow springs radially inward a greater distance than the small spacer 54*a*, but more than the larger spacer 54*c*. As would be understood by those skilled in the art, the spacer can take various forms, such as simple longitudinal rods 53, as illustrated in FIGS. 12A and 12B.

Figure 11A:
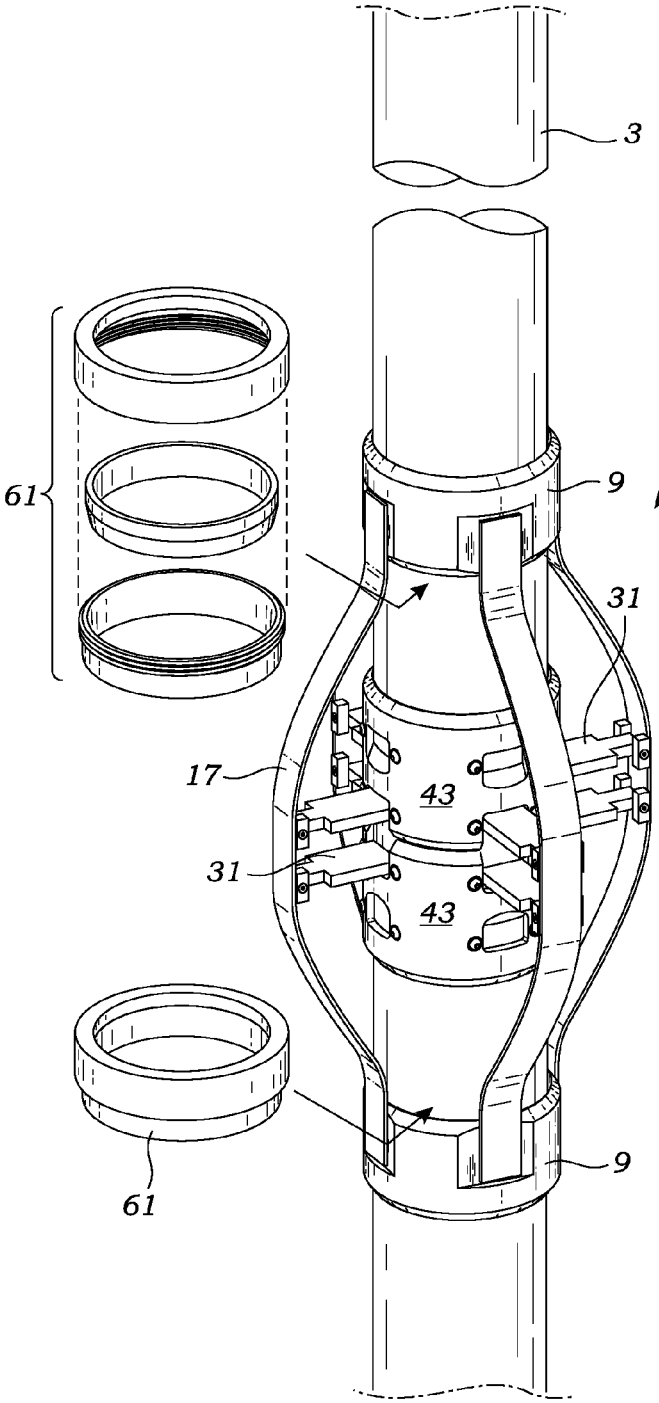
FIG. 11A is a perspective view of a centralizer and well casing prior to affixing locking rings to a pipe to force the end collars longitudinally outward.
Figure 11B:
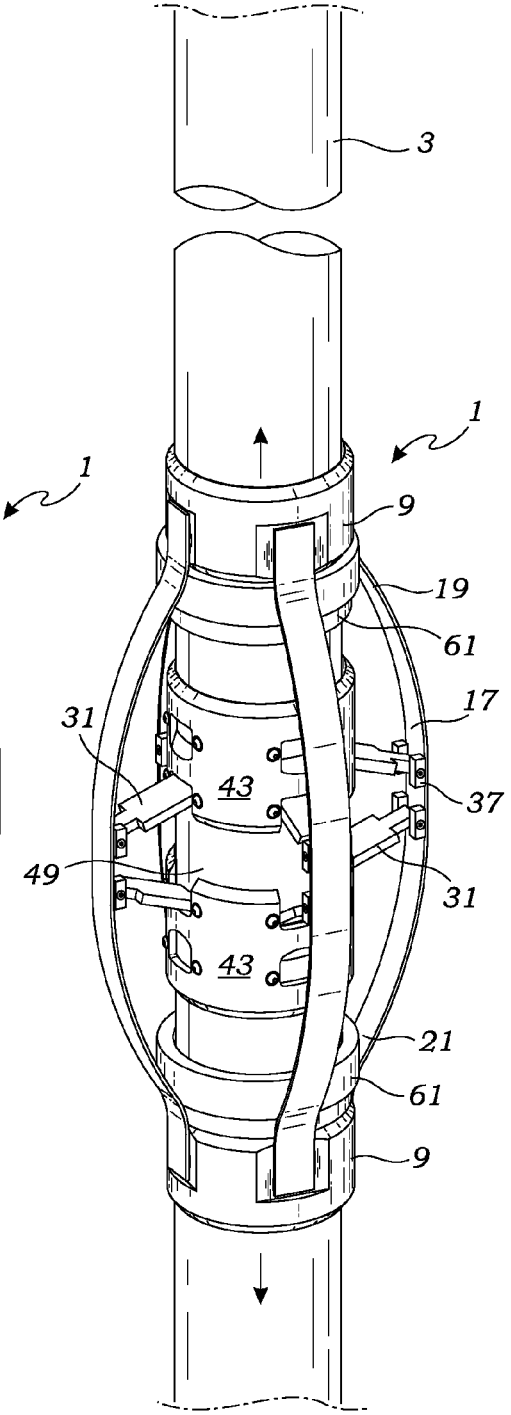
FIG. 11B is a perspective view illustrating the centralizer and well casing shown in FIG. 11A wherein the locking rings have been affixed to the well pipe in a manner that caused the end collars to be forced longitudinally apart, and caused the bow springs and linkage assemblies to be forced radially inward, and caused the center collars to move longitudinally apart.

The bow springs may be forced radially inward utilizing still additional constructions. For example, FIGS. 8A and 8B illustrate a centralizer 1 including a plurality of flexible straps 55 and pins 57 which function as "tension members" so as to pull center collars 43 towards adjacent end collars 9. In still alternative embodiments, the pipe may be constructed to include mechanical structures, such as projections, which lock the end collars into longitudinally extended positions so as to force the bow springs radially inward. The projections may be simple pins or bolts (not shown) affixed to the pipe's sidewall, which are positioned to maintain the end collars in an extended position. Alternatively, as illustrated in FIGS. 11A and 11B, the pipe 3 may include fixed or adjustable ring-like structures 61 which affix to the pipe so as to maintain the end collars 9 in a longitudinally extended condition. Though not shown in the figures, the pipe may include projections, such as pins, bolts, or rings which engage both center collars, or a single center collar and end collar, so as to force the bow springs 17 radially inward.

Figure 3:
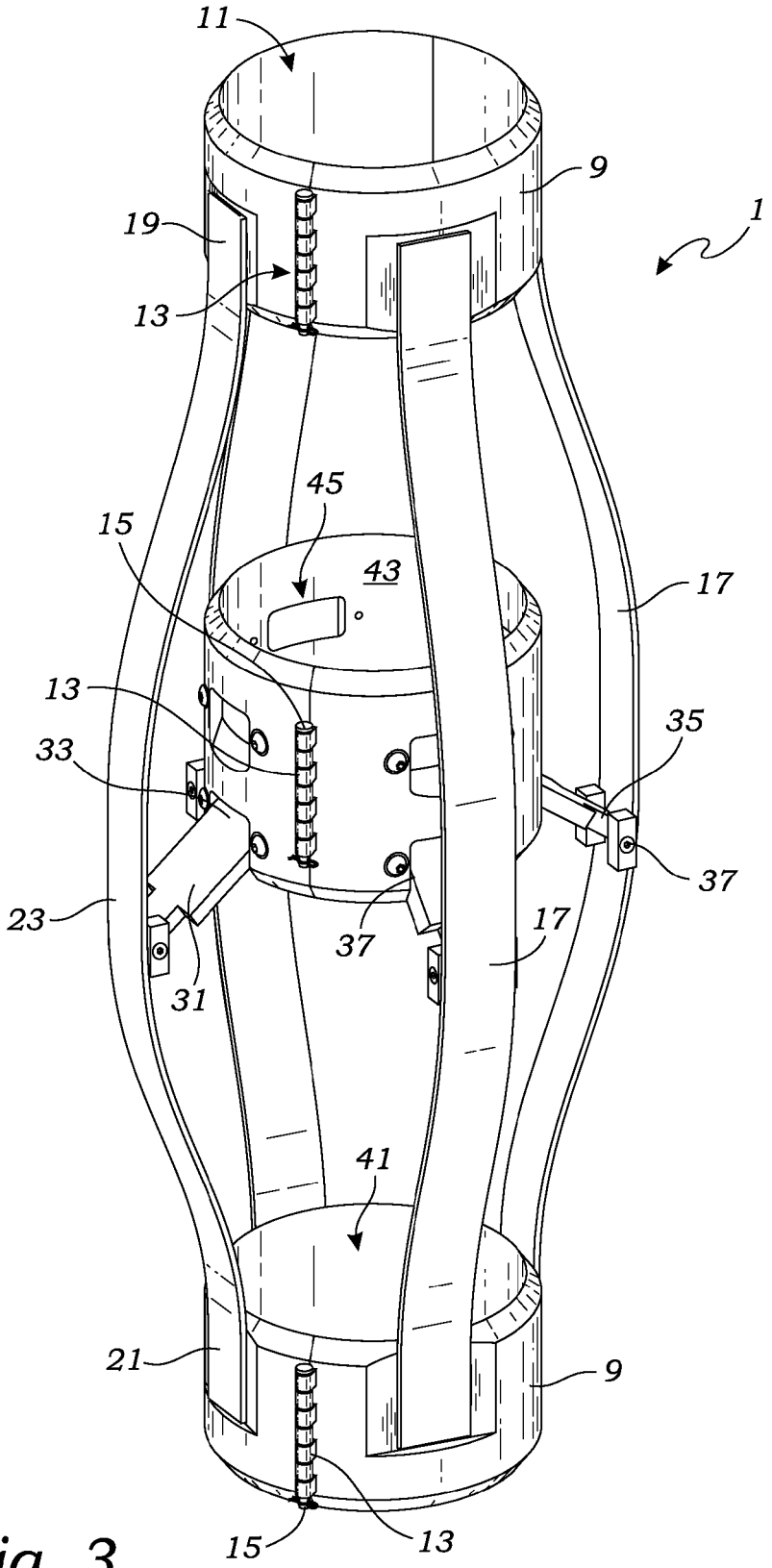
FIG. 3 is a perspective view of a centralizer including a single center collar and wherein the end collars and center collar are hinged to allow the centralizer to open in a clamshell manner.
Figure 4:
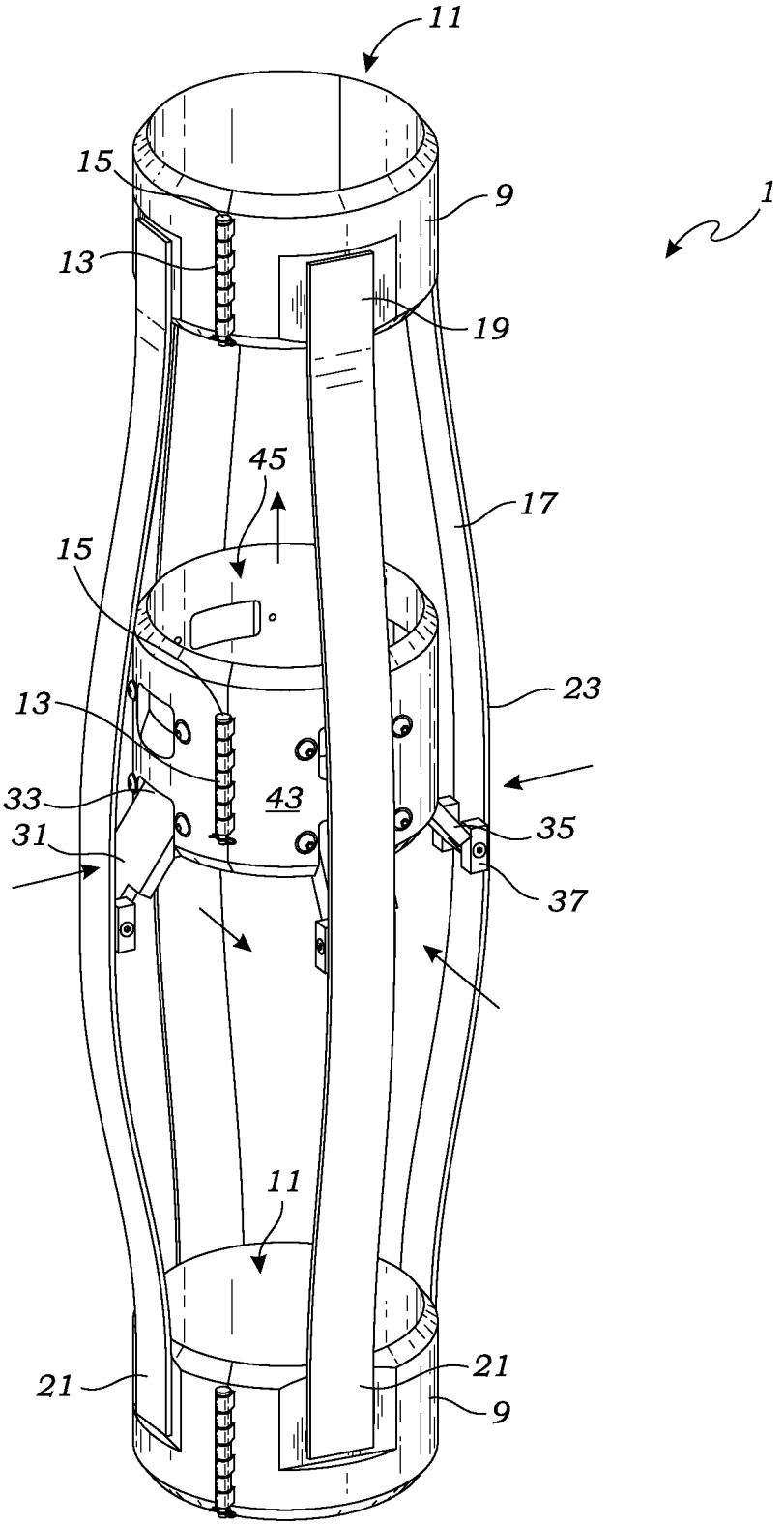
FIG. 4 is a perspective view illustrating the centralizer shown in FIG. 3 wherein the bow springs have been forced radially inward and the center collar has moved longitudinally upward.
Figure 5:
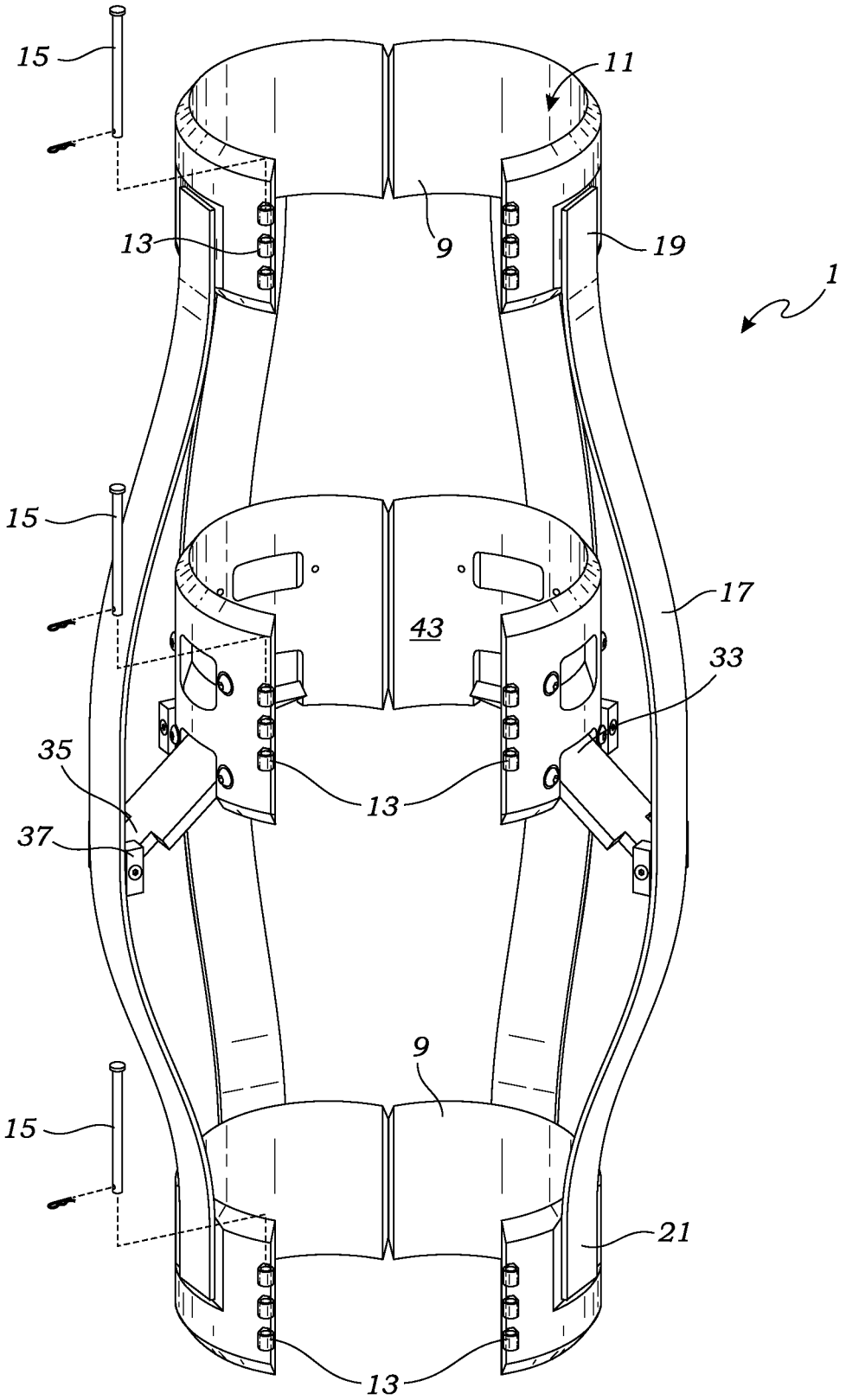
FIG. 5 is a perspective view illustrating the centralizer shown in FIGS. 3 and 4 wherein a first set of locking pins has been removed so as to allow the centralizer to hinge open to accept the pipe.
Figure 6:
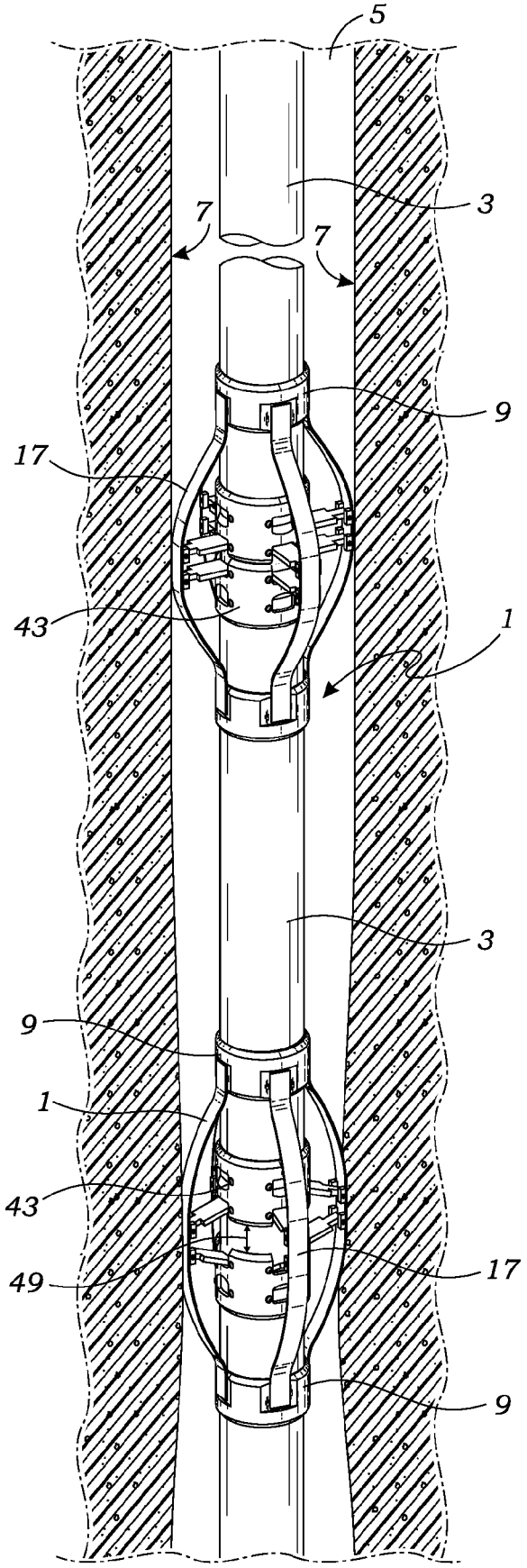
FIG. 6 is a perspective cut-away view of a wellbore including a pipe casing and centralizers as illustrated in FIG. 1.

In still additional embodiments of the invention illustrated in FIGS. 3-5, the end collars 9 and center collar 43 include a hinge 13 to allow a centralizer to open in a clamshell member so as to receive a pipe, and thereafter be closed for affixing the centralizer 1 to a pipe 3. In a preferred embodiment illustrated in FIGS. 3-5, each end collar 9 and center collar 43 includes two diametrically opposed hinges which can open or close by removal of a longitudinally extending set pin 15. Removing one side of the set pins 15 enables the centralizer 1 to open or close in a clamshell member. Meanwhile, removal of all set pins permits the centralizer 1 to be separated in half. Removal of either one side of the pins or both sides of the pins permits the centralizer to be affixed to a pipe. Thereafter, the pins 15 can be reinserted into the hinges 13 so as to affix the centralizer 1 to the pipe 3.

While several particular forms of the invention have been illustrated and described, it will be apparent that various modifications can be made without departing from the spirit and scope of the invention. Therefore, it is not intended that the invention be limited to the specific embodiments illustrated. I described my invention in such terms as to enable a person skilled in the art to understand the invention, recreate the invention and practice it, and having presently identified the presently preferred embodiments thereof,

I claim:

1. A centralizer for centralizing a pipe downhole, the centralizer comprising:

first and second end collars, each of said end collars being tubular and having a center hole defining a longitudinal axis for receiving a pipe, said end collars coaxial to said longitudinal axis and axially spaced to one another;

a plurality of outwardly bowed bow springs having first and second ends, said bow springs' first ends attached to said first end collar and said bow springs' second ends attached to said second end collar so that said bow springs span the space between said end collars and said bow springs substantially equally spaced circumferentially around said end collars;

a first center collar being tubular with a center hole coaxial to said longitudinal axis for receiving a pipe, said first center collar positioned intermediate to said end collars;

a first set of a plurality of linkage arms having first and second ends, each of said linkage arms' first ends attached to said first center collar and each of said linkage arms second ends attached to a bow spring intermediate to said end collars so as to span the radial space between said center collar and said bow springs;

a second center collar being tubular with a center hole coaxial to said longitudinal axis for receiving a pipe, said second center collar positioned intermediate to said end collars;

a second set of a plurality of linkage arms having first and second ends, each of said second linkage arms' first ends attached to said second center collar and each of said linkage arms second ends attached to a bow spring intermediate to said end collars so as to span the radial space between said second center collar and said bow springs; and one or more spacers positioned between said first center collar and said second center collar for forcing said first center collar axially away from said second center collar and for moving said first set of linkage members and bow springs radially inward to reduce the outer diameter of said bow springs and to store mechanical energy in said bow springs and for displacing said first center collar from said first center collar's at rest position.

2. The centralizer for centralizing a pipe down hole of claim 1 wherein said linkage arms function as leaf springs storing mechanical energy when said linkage arm's second ends are forced radially inward so that said arms second ends exert an increasing outward force in the manner of a leaf spring as an attached bow spring is forced radially inward.

3. A well, pipe and centralizer combination comprising:

a well including a bore having a diameter extending into the ground;

a pipe extending downhole;

first and second end collars, each of said end collars being tubular and having a center hole defining a longitudinal axis for receiving said pipe, said end collars coaxial to said longitudinal axis and axially spaced to one another;

a plurality of outwardly bowed bow springs having first and second ends, said bow springs' first ends attached to said first end collar and said bow spring's second ends attached to said second end collar so that said bow springs span the space between said end collars and said bow springs substantially equally spaced circumferentially around said end collars;

a first center collar being tubular with a center hole coaxial to said longitudinal axis for receiving said pipe, said first center collar positioned intermediate to said end collars;

a first set of a plurality of linkage arms having first and second ends, each of said linkage arms' first ends attached to said first center collar and each of said linkage arms' second ends attached to a bow spring intermediate to said end collars so as to span the radial space between said center collar and said bow springs;

a second center collar being tubular with a center hole coaxial to said longitudinal axis for receiving a pipe, said second center collar positioned intermediate to said end collars; and a second set of a plurality of linkage arms having first and second ends, each of said second linkage arms' first ends attached to said second center collar and each of said linkage arms second ends attached to a bow spring intermediate to said end collars so as to span the radial space between said second center collar and said bow springs; and one or more spacers positioned between said first center collar and said second center collar for forcing said first center collar axially away from said second center collar and for moving said first set of linkage members and bow springs radially inward to reduce the outer diameter of said bow springs to reduce the diameter of said centralizer to less than the diameter of said wellbore and to store mechanical energy in said bow springs and for displacing said first center collar from said first center collar's at-rest position.

4. The centralizer for centralizing the pipe downhole of claim 3 wherein said linkage arms function as leaf springs storing mechanical energy when said linkage arm's second ends are forced radially inward so that said arms second ends exert an increasing outward force in the manner of a leaf spring as an attached bow spring is forced radially inward.

5. A centralizer for centralizing the pipe downhole, the centralizer comprising:

first and second end collars, each of said end collars being tubular and having a center hole defining a longitudinal axis for receiving a pipe, said end collars coaxial to said longitudinal axis and axially spaced to one another;

a plurality of outwardly bowed bow springs members having first and second ends, said bow springs' first ends attached to said first end collar and said bow springs' second ends attached to said second end collar so that said bow springs span the space between said end collars and said bow springs substantially equally spaced circumferentially around said end collars;

a first center collar, said first center collar being tubular with a center hole coaxial to said longitudinal axis for receiving a pipe, said first center collar positioned intermediate to said end collars; and a first set of a plurality of linkage spring arms having first and second ends, each of said linkage spring arms' first ends attached to said first center collar and each of said linkage spring arms' second ends attached to a bow spring intermediate to said end collars so as to span the radial space between said center collar and said bow springs, said first set of linkage spring arms storing mechanical energy when said arm's second ends are forced radially inward so as to exert an increasing outward force in the manner of a leaf spring as an attached bow spring is forced radially inward;

a second center collar, said second center being tubular with a center hole coaxial to said longitudinal axis for receiving a pipe, said second center collar positioned intermediate to said end collars; and a second set of a plurality of linkage arms having first and second ends, each of said second linkage arms' first ends attached to said second center collar and each of said linkage arms second ends attached to a bow spring member intermediate to said end collars so as to span the radial space between said second center collar and said bow springs, said second set of linkage spring arms storing mechanical energy when said arm's second ends are forced radially inward so as to exert an increasing outward force in the manner of a leaf spring as an attached bow spring member is forced radially inward; and one or more spacers positioned between said first center collar and said second center collar for forcing said first center collar axially away from said second center collar.

6. A centralizer for centralizing a pipe downhole, the centralizer comprising:

first and second end collars, each of said end collars being tubular and having a center hole defining a longitudinal axis for receiving a pipe, said end collars coaxial to said longitudinal axis and axially spaced to one another;

a plurality of outwardly bowed bow springs having first and second ends, said bow springs' first ends attached to said first end collar and said bow springs' second ends attached to said second end collar so that said bow springs span the space between said end collars and said bow springs substantially equally spaced circumferentially around said end collars;

a first center collar being tubular with a center hole coaxial to said longitudinal axis for receiving a pipe, said first center collar positioned intermediate to said end collars;

a first set of a plurality of linkage arms having first and second ends, each of said linkage arms' first ends attached to said first center collar and each of said linkage arms second ends attached to a bow spring intermediate to said end collars so as to span the radial space between said center collar and said bow springs;

a second center collar being tubular with a center hole coaxial to said longitudinal axis for receiving a pipe, said second center collar positioned intermediate to said end collars;

a second set of a plurality of linkage arms having first and second ends, each of said second linkage arms' first ends attached to said second center collar and each of said linkage arms second ends attached to a bow spring intermediate to said end collars so as to span the radial space between said second center collar and said bow springs;

one or more tension members having first and second ends, each of said tension members' first ends attached to said first center collar and said tension members' second ends attached to said second end collar for pulling said first center collar toward said second end collar and displacing said center collar axially away from said first end collar thereby moving said first set of linkage members and bow springs radially inward to reduce the outer diameter of said bow springs and to store mechanical energy in said bow springs and for displacing said first center collar from said first center collar's at rest position.

7. The centralizer for centralizing a pipe down hole of claim 6 wherein said linkage arms function as leaf springs storing mechanical energy when said linkage arm's second ends are forced radially inward so that said arms second ends exert an increasing outward force in the manner of a leaf spring as an attached bow spring is forced radially inward.

* * * * *